United States Patent [19]

Fischer

[11] 4,202,132

[45] May 13, 1980

[54] HOLLOW STRUCTURAL ELEMENT

[76] Inventor: Artur Fischer, Weinhalde 34, D-7244 Waldachatl 3 (Tumlingen, Fed. Rep. of Germany

[21] Appl. No.: 913,081

[22] Filed: Jun. 6, 1978

[30] Foreign Application Priority Data

Jun. 29, 1977 [DE] Fed. Rep. of Germany ..... 2729264
Jan. 19, 1978 [DE] Fed. Rep. of Germany ..... 2802149

[51] Int. Cl.[2] ..... A63H 33/00; A63H 27/00; A63H 33/10; A63H 33/08

[52] U.S. Cl. ..... 46/16; 46/76 R; 46/31; 46/25

[58] Field of Search ..... 46/23–31, 46/16, 76 R; 403/381; 428/33, 35, 36, 542; 206/509, 516

[56] References Cited

U.S. PATENT DOCUMENTS

| | | | |
|---|---|---|---|
| 3,354,576 | 11/1967 | Gralnick | 46/11 |
| 3,479,762 | 11/1969 | Fischer | 46/11 |
| 3,777,392 | 12/1973 | Span et al. | 46/11 |
| 3,934,605 | 1/1976 | Legris | 46/25 |
| 3,946,515 | 3/1976 | Fischer | 46/17 |
| 3,946,516 | 3/1976 | Wirth | 46/17 |
| 4,102,529 | 7/1978 | Neblung et al. | 403/381 |

*Primary Examiner*—Louis G. Mancene
*Assistant Examiner*—Michael J. Foycik, Jr.
*Attorney, Agent, or Firm*—Michael J. Striker

[57] ABSTRACT

A hollow structural element has a hollow member having a circumferential wall and a side wall which closes one of the axial ends of the circumferential wall, a cover member arranged to close the other end of the circumferential wall of the hollow member and connecting elements for connecting the structural element with other structural elements. The connecting elements include an undercut projection provided in the cover member and arranged for inserting into an undercut groove of another structural element, and an undercut lateral slot provided in the side wall of the hollow member and arranged for engaging with an undercut projection of a further structural element. The lateral slot has a first enlarged portion through which the projection of the further structural element can pass, and a second reduced portion extending from the first portion toward the axis of the circumferential wall and dimensioned so that the projection of the further structural element engages in the reduced portion.

18 Claims, 4 Drawing Figures

HOLLOW STRUCTURAL ELEMENT

BACKGROUND OF THE INVENTION

The present invention relates to a hollow structural element, and more particularly to such a hollow structural element which is closed by a collar member and provided on its side walls with connecting means.

Hollow structural elements of this known type are provided with connecting means for connecting the same with other structural elements. Inasmuch as such elements do not provide for sufficiently strong connection, they are of little use for constructing stable and bend-resistant fuselage of flying models or the like. Hollow structural elements have been further proposed which have a square or rectangular cross-section and are provided with undercut connecting elements wherein undercut grooves formed in a circumferential wall of the hollow structural element cuts out both side walls limiting the circumferential wall. When fuselages of flying models and the like are assembled, the remained cutouts of the outer face of the circumferential wall considerably deteriorate the appearance of the structural element.

SUMMARY OF THE INVENTION

Accordingly, it is an object of the present invention to provide a hollow structural element which avoids the disadvantages of the prior art.

More particularly, it is an object of the present invention to provide a hollow structural element which forms a strong connection for assembling, for example, fuselages of flying models wherein the visible outer surfaces are not undesirably affected by connecting means.

In keeping with these objects, and with others which will become apparent hereinafter, one feature of the present invention resides, briefly stated, in a hollow structural element which has a hollow member having a circumferential wall and a side wall closing one of the ends of the circumferential wall, a cover member arranged to close the other end of the circumferential wall of the cover member, and means for connecting the hollow structural element with other structural elements, wherein the connecting means includes an undercut projection provided in the cover member and arranged for inserting into an undercut groove of another structural element, and an undercut lateral slot provided in the side wall of the hollow member and aranged for interacting with an undercut projection of a further structural element. The undercut lateral slot has a first enlarged portion located adjacent to the circumferential wall and dimensioned so that the projection of the further structural element passes through the enlarged portion, and a second reduced portion which extends from the first portion toward the axis and is dimensioned so that the projection of the further structural element engages in the reduced portion.

In order to assemble two hollow structural elements with one another they are so displaced relative to one another that the undercut projection of one of the elements is inserted into the first enlarged portion of lateral slot of the other structural element. Then, both structural elements are so displaced relative to one another that their outer surfaces of the circumferential walls are in alignment with one another by means of displacement of the undercut projection in the undercut groove. The high-strength connection is attained so that the assembling of stable and bend-resistant fuselages for flying models becomes possible. Since the connecting means is not visible on the outer face of the structural element the thus assembled fuselage remains smooth so that especially original appearance can be attained by impressing on the fuselage a row of windows, symbols, signs and the like.

The circumferential wall of the hollow member and the side walls thereof provided with the lateral slot can be manufactured by an injection molding process. After this, the cover member provided with connecting projection and manufactured by a separate injection molding process is inserted through an open end of the cap-shaped hollow member and connected thereto by means of glueing or ultrasonic welding.

The projection of the cover member may be formed as an assembling pin. The hollow member may be cup-shaped and the circumferential wall thereof may be cylindrical. The second portion of the lateral slot of the side wall of the hollow member may extend outwardly beyond the axis so as to permit relative displacement of the hollow connecting elements to be connected with one another.

Another feature of the present invention is that the second reduced portion of the lateral slot of the side wall extends outwardly beyond the axis of the hollow member by a distance which is substantially equal to half of a transverse dimension of the projection of the cover member. The thus dimensionally limited second portion of the lateral slot forms an abutment for the projection of the cover member so that when the projection of the cover member engages in the second portion of the lateral slot, the outer faces of the circumferential walls of two hollow structural elements connected with one another are in alignment with each other. In such a construction the fuselage portions can be exactly adjusted relative to one another in a simple manner, that is conventionally especially difficult for small children as a result of different sliding friction and static friction.

In accordance with still another feature of the present invention, the cover member has a sleeve-shaped extension portion having an elongated inner hole into which the projection or the assembling pin is pressed. On the grounds of wear, the projection and the structural element are manufactured of differing materials. In order to obtain a firm pressure connection for the connecting projection, the connecting projection is received in a portion of the cover which is formed as the above-mentioned sleeve-shaped extension in view of the material economy considerations. The cylindrical elongated portion of the connecting projection is provided with ribs which serve for roughening the same.

In accordance with a further feature of the present invention, two elongated slots are provided in the circumferential wall of the hollow member and located opposite to one another. The elongated slots extend from the open end of the hollow member which is closed by the cover member. This makes possible to fix additional elements on the circumferential wall of the structural element, for example, wings of the flying model. Since the elongated slots are open at the end of the hollow member, the above-mentioned elements, such as wings, must be inserted into these slots prior to connecting further structural elements to the hollow member.

In accordance with a still further feature of the present invention, the elongated slots provided in the circumferential wall of the hollow member have end sections which are open at the end of the circumferential wall and have an enlarged cross-section. This facilitates the insertion of the structural elements such as wings into the elongated slots.

In accordance with an additional feature of the present invention the portion of the circumferential wall which is provided with the elongated slot is flat. In such a construction a flat improved abutment of the structural elements, such as wings, against the outer surface of the circumferential wall is provided.

In accordance with a still additional feature of the present invention the cover member is provided with two such undercut projections, and the side wall of the hollow member is provided with two such undercut slots. The distance between the undercut projections as well as the distance between the undercut slots is twice as much as the distance between the outer surface of the circumferential wall and the adjacent one of the undercut projection or the undercut slot, respectively. Due to this arrangement of the connecting means in pairs, the structural elements connected with one another are completely secured against relative rotation. Moreover, this gives a possibility to connect the structural elements in an offset position relative to one another so as to form substantially flat models, for example, floating bodies.

In order to improve the carrying capacity of such floating bodies, it is possible, in accordance with yet another feature of the present invention, to provide a plate-like coating element which has undercut projections engaging in the undercut slots of the structural elements.

The novel features which are considered as characteristic for the invention are set forth in particular in the appended claims. The invention itself, however, both as to its construction and its method of operation, together with additional objects and advantages thereof, would be best understood from the following description of specific embodiments when read in connection with the accompanying drawings.

DESCRIPTION OF THE PREFERRED EMBODIMENTS

Figure 1:
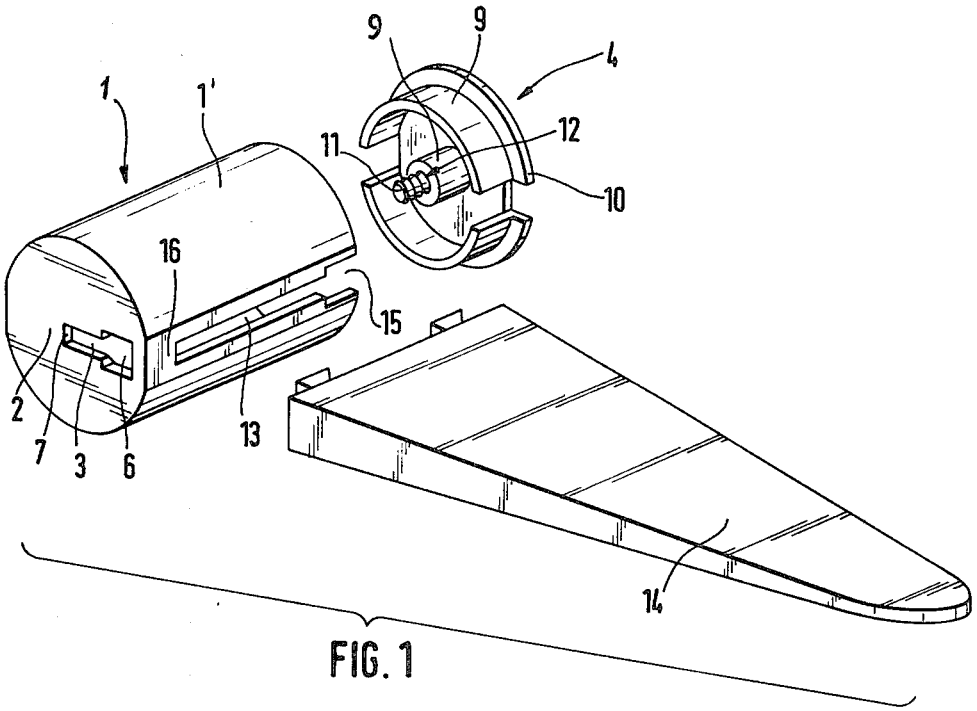
FIG. 1 is a perspective view of a hollow structural element in accordance with the present invention.

A hollow structural element in accordance with the present invention has a hollow member which is identified by reference numeral 1. The hollow member 1 is cup-shaped and has a cylindrical circumferential wall 1'. A side wall 2 forming a bottom of the hollow member 1 is provided at one end of the latter. The side wall 2 has a lateral slot. This slot includes an undercut portion 3 and a portion 6. The portion 6 of the slot is located adjacent to the circumferential wall 1' of the hollow member and has a greater cross-section, whereas the undercut portion 3 of the lateral slot extends from the portion 6 toward the axis of the circumferential wall and has a smaller cross-section.

A cover member 4 with an assembling pin 5 is provided. The assembling pin has a head section 5', and a portion 6 of the lateral slot of the hollow member 1 has a transverse dimension substantially corresponding to that of the head section 5' of the pin 5. The portion 3 of the lateral slot of the hollow member 1 extends from portion 6 thereof outwardly beyond the axis of the hollow member 1. It extends beyond this axis by a distance which is substantially equal to half of the transverse dimension of the pin 5. A limiting edge 7 of the lateral slot forms an abutment face for a neck portion 8 of the pin 5 so that when the pin 5 of one of the structural elements is engaged with the portion 3 of the lateral slot of another structural element, the outer surfaces of the circumferential walls 1 thereof are in alignment with one another.

The cover 4 which carries the assembling pin 5 seals the hollow member 1. The cover 4 has an outer sleeve-shaped portion 9 which extends from a side flange 10. When the cover member 4 closes an open end of the hollow member 1 the outer sleeve-shaped portion 9 abuts inwardly against the inner surface of the hollow member 1. More particularly, the flange 10 closes the open end of the hollow member 1. The fixation of the cover member 4 can be performed by glueing or ultrasonic welding.

In order to improve the holding capacity of the assembling pin, the cover member 4 has an inner sleeve-shaped portion 9' which extends from the flange 10 and has an inner hole 12. The pin 5 has a section 11 which is provided with ribs 12 and pressed into the inner hole 12 of the elongated sleeve-shaped portion 9' of the cover member 4.

In order to attach additional structural elements to the circumferential wall 1' of the hollow member, for instance for assembling flying models, the circumferential wall 1' has two elongated slots extending from an open end of the circumferential wall 1', which end is closed by the cover member 4. Each of the elongated slots of the circumferential wall 1' has an undercut portion 13. A further structural element 14 is attached to the circumferential wall 1' by insertion of the former through the open end of the elongated slot before closing the open end by the cover member 4. In order to facilitate the insertion of the element 14 into the elongated slot, each of the elongated slots has a portion 15 located adjacent the open end of the circumferential wall 1' and having an increased cross-section. In order to improve the connection of the element 14 to the circumferential wall 1', the latter has a flat portion 16 in the region of the elongated slot. Thus, the element 14 abuts against the circumferential wall 1' with a flat surface contact.

It is to be understood that the interior space of the hollow member 1 is so dimensioned as to accommodate battery cells, electric motors or the like, for instance for assembling motor-driven flying models. Further, the hollow member 1 can be so manufactured that the interior space thereof can accommodate required wiring for the models.

Figure 2:
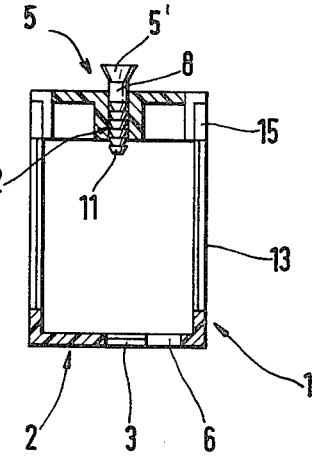
FIG. 2 is a view showing a section of the hollow structural element with a cover member attached thereto.
Figure 3:
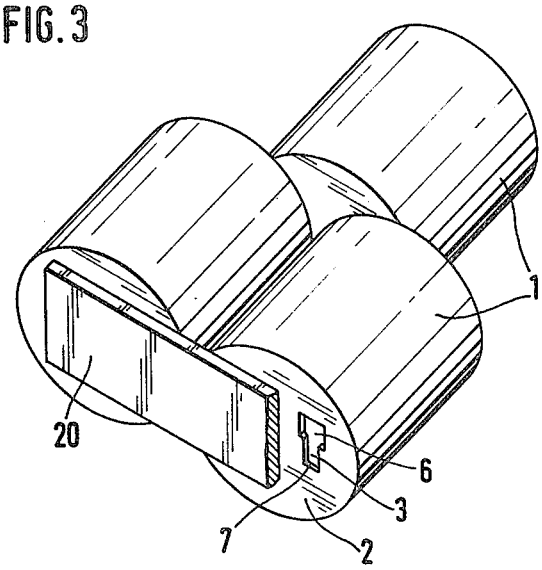
FIG. 3 is a view illustrating assembling of a floating body.
Figure 4:
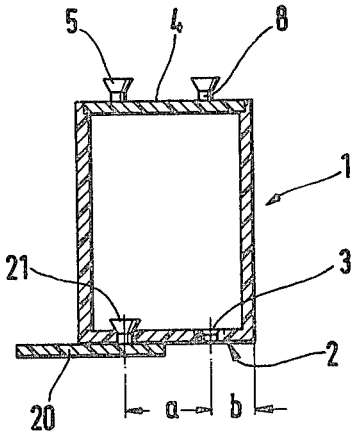
FIG. 4 is a view showing a section of the hollow element of FIG. 3.

The hollow member 1 which is shown in FIGS. 3 and 4 have two lateral slots provided in the side wall 2. Each of the lateral slots has an undercut portion 3 of a smaller cross-section and a portion 6 of a greater cross-section, similarly to the lateral slot shown in FIGS. 1 and 2. The portion 3 extends from the portion 6 outwardly beyond the axis of the hollow member 1 by a distance substantially corresponding to half of the outer dimension of the neck section 8 of the assembling pin 5. The limiting edge 7 of the lateral slot forms an abutment surface for the neck 8 of the assembling pin 6 so that when the structural elements are connected with one another their outer surfaces of the circumferential walls 1' are in alignment with one another. The cover member 4 has two undercut assembling pins 5. The fixation of the cover member 4 which carries the pins 5 can be performed by glueing or ultrasonic welding.

The distance a between the connecting members, that is between the lateral slots or between the pins 5 is twice as much as the distance b between the outer surface of the circumferential wall 1' and an adjacent one of the lateral slots or projections, respectively. With such a construction, the structural elements may be offset relative to and connected with one another so as to form a model with a flat surface, for instance, a floating body. In order to improve the carrying capacity of the thus-formed floating body, the lateral slots of the structural elements which remain open after assembling of the structural elements with one another, are water-tightly closed by a plate-like element 20. The plate-like element 20 has undercut connecting projections 21 which engage in the undercut lateral flats of the structural element 1.

It will be understood that each of the elements described above, or two or more together, may also find a useful application in other types of constructions differing from the types described above.

While the invention has been illustrated and described as embodied in a hollow structural element it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hollow structural element, comprising a cylindrical hollow member having an axis, a circumferential wall and two ends spaced from one another in an axial direction, said hollow member having an end wall arranged to close one of said ends of said circumferential wall; a cover member arranged to close the other end of said circumferential wall of said hollow member; and means for connecting the hollow structural element with other structural elements, said means including an undercut projection provided in said cover member and arranged for inserting into an undercut groove of another structural element, and an undercut lateral slot provided in said end wall of said hollow member and arranged for interacting with an undercut projection of a further structural element so that the structural elements can be connected with each other while being located axially adjacent to one another, said undercut lateral slot having a first portion of an enlarged cross section which is located adjacent to said circumferential wall and dimensioned so that the projection of the further structural element passes through said enlarged portion, and a second portion of a reduced cross section which extends from said first portion toward said axis and is dimensioned so that the projection of the further structural element engages in said second portion, said second portion of said undercut lateral slot of said end wall extending outwardly beyond said axis by a distance which is substantially equal to half of a transverse dimension of said undercut projection, so that when such hollow structural elements are connected with one another by means of interaction of the undercut lateral slot of one of the structural elements with the undercut projection of the further structural element, the circumferential walls of the hollow members of the structural elements are in alignment with each other.

2. The structural element as defined in claim 1, wherein said projection is elongated and extends outwardly from said cover member, said projection having a first section of an enlarged cross section which is spaced from said cover member and a second section of a reduced cross section which is located adjacent to said cover member, said first portion of said lateral slot of said end wall of said hollow member being dimensioned corresponding to said first section of said projection so that said first section can pass through said first portion of said slot.

3. The structural element as defined in claim 2, wherein said projection is an assembling pin.

4. The structural element as defined in claim 1, wherein said hollow member is cup-shaped.

5. The structural element as defined in claim 2, wherein said cover member has a body portion and a sleeve-shaped extension portion which extends from said body portion and has an elongated inner hole, said projection being a separate member which is inserted into said inner hole of said extension portion.

6. The structural element as defined in claim 5, wherein said cover member has a further axis, said extension portion and said inner hole thereof extending in the direction of said further axis.

7. The structural element as defined in claim 6, wherein said second section of said projection is received in said inner hole of said extension portion of said cover member, whereas said first section of said projection extends outwardly beyond the same.

8. The structural element as defined in claim 1, wherein said circumferential wall of said hollow member has at least one elongated undercut slot which extends from said other end of said circumferential wall.

9. The structural element as defined in claim 8, wherein said elongated slot extends substantially in said axial direction.

10. The structural element as defined in claim 8, wherein said circumferential wall has at least one second such elongated slot which is located opposite to said first-mentioned elongated slot.

11. The structural element as defined in claim 8, wherein said elongated slot has an end section which is open at said other end of said circumferential wall and has an enlarged cross section.

12. The structural element as defined in claim 8, wherein said circumferential wall of said hollow member has a flat portion in which said elongated slot is provided.

13. The structural element as defined in claim 1, wherein said connecting means further has a second such undercut projection provided in said cover member and a second such undercut lateral slot provided in said end wall of said hollow member, which are spaced from said first-mentioned projection and lateral slot, respectively, in a direction which is transverse to said axis.

14. The structural element as defined in claim 13, wherein said second projection is spaced from said first-mentioned projection and said second lateral slot is spaced from said first-mentioned lateral slot by a distance which is twice as much as a distance by which said circumferential wall is spaced from an adjacent one of said projections and lateral slots, respectively.

15. The structural element as defined in claim 1, wherein said end wall of said hollow member has a second such undercut lateral slot; and further comprising a closing element arranged for water-tightly closing at least one of said lateral slots of said end wall of said hollow member.

16. The structural element as defined in claim 15, wherein said closing element has a body section and a projecting section which is arranged to engage in said one lateral slot.

17. The structural element as defined in claim 16, wherein said body section of said closing element is plate-like.

18. The structural element as defined in claim 16, wherein said body section is elongated and has a second such projecting section which is spaced from said first-mentioned projecting section in the direction of elongation of said body section so that each of said projecting sections engages in and closes the lateral slot of a respective one of two adjacently located such structural elements.

* * * * *